US007395580B2

(12) United States Patent
Brüstle et al.

(10) Patent No.: US 7,395,580 B2
(45) Date of Patent: Jul. 8, 2008

(54) HINGE

(75) Inventors: Klaus Brüstle, Höchst (AT); Fredi Dubach, Baäretwil (CH)

(73) Assignee: Julius Blum Gesellschaft m.b.H., Hochst (AT)

( * ) Notice: Subject to any disclaimer, the term of this patent is extended or adjusted under 35 U.S.C. 154(b) by 0 days.

(21) Appl. No.: 11/248,256

(22) Filed: Oct. 13, 2005

(65) Prior Publication Data

US 2006/0026792 A1 Feb. 9, 2006

Related U.S. Application Data

(63) Continuation of application No. PCT/AT2004/000126, filed on Apr. 9, 2004.

(30) Foreign Application Priority Data

Apr. 15, 2003 (AT) ..... A 577/2003

(51) Int. Cl.
*E05F 3/20* (2006.01)
*E05F 3/22* (2006.01)

(52) U.S. Cl. ..... 16/50; 16/71

(58) Field of Classification Search ..... 16/50, 16/51, 54, 354, 335, 344, 286–288, DIG. 21; 188/293–296, 300
See application file for complete search history.

(56) References Cited

U.S. PATENT DOCUMENTS

| | | | | | |
|---|---|---|---|---|---|
| 3,772,736 | A | * | 11/1973 | Hettich et al. | 16/288 |
| 3,975,791 | A | | 8/1976 | Hettich et al. | |
| 4,329,759 | A | * | 5/1982 | Lautenschlager | 16/335 |
| 5,269,043 | A | * | 12/1993 | Yang | 16/68 |
| 6,032,333 | A | * | 3/2000 | Brustle | 16/242 |
| RE37,236 | E | * | 6/2001 | Brustle et al. | 16/383 |
| 6,591,454 | B2 | * | 7/2003 | Brustle | 16/374 |
| 7,127,778 | B2 | * | 10/2006 | Salice | 16/354 |
| 2002/0046441 | A1 | * | 4/2002 | Brustle | 16/254 |
| 2003/0200625 | A1 | | 10/2003 | Zimmer | |
| 2004/0205935 | A1 | * | 10/2004 | Lautenschlaeger et al. | 16/374 |

FOREIGN PATENT DOCUMENTS

| | | | |
|---|---|---|---|
| AT | 005 477 U1 | | 7/2002 |
| DE | 92 10 092 | | 11/1992 |
| DE | 102 19 172.7 | * | 4/2002 |
| DE | 101 59 140 | | 7/2002 |
| DE | 202 05 905 | | 8/2002 |
| DE | 101 21 977 | | 11/2002 |
| DE | 201 15 250 U1 | | 12/2002 |
| DE | 203 03 534.8 | * | 3/2003 |
| DE | 102 27 078 A1 | | 1/2004 |
| EP | 1 199 433 A2 | | 4/2002 |
| EP | 1 359 275 A2 | | 11/2003 |
| WO | 03/087512 | | 10/2003 |
| WO | WO 3087512 A1 | * | 10/2003 |

* cited by examiner

*Primary Examiner*—Robert J. Sandy
*Assistant Examiner*—Ruth C. Rodriguez
(74) *Attorney, Agent, or Firm*—Wenderoth, Lind & Ponack, L.L.P.

(57) ABSTRACT

A hinge with a hinge cup can be inserted into a boring in a furniture part. A damper housing is fixed onto the hinge cup, and the damper housing can be fastened onto or removably secured to the hinge cup. The damper housing is disposed at least partially outside the boring when the hinge cup is inserted into the boring in the furniture part.

19 Claims, 10 Drawing Sheets

HINGE

This application is a continuation of International Application No. PCT/AT2004/000126, filed Apr. 9, 2004.

BACKGROUND OF THE INVENTION

The invention concerns a hinge with a hinge cup which can be inserted into a boring in a furniture part, with a damper housing fixed onto the hinge cup.

Hinges fitted with a damper which brakes furniture doors during closing are known in the art from EP 1 199 433 A2, from the Austrian utility model AT 005 477 U1 and the German utility models DE 201 15 250 U and DE 202 05 905 U. The problem addressed by the present invention is to create a hinge with a damper such that the damper can be used universally.

SUMMARY OF THE INVENTION

The problem is solved by the fact that the damper housing can be fastened onto or removably secured to the hinge cup so that the damper housing is disposed at least partially outside the boring when the hinge cup is inserted into the boring in the furniture part.

Advantageously, the damper housing can be disposed entirely outside the boring when the hinge cup is inserted into the boring in the furniture part.

In a further embodiment of the invention, the hinge cup has a flange abutting on the furniture doors and the damper housing is anchored on the flange of the hinge cup.

BRIEF DESCRIPTION OF THE DRAWINGS

An embodiment of the invention will now be described with the aid of the figures in the attached drawings, wherein.

DETAILED DESCRIPTION OF THE INVENTION

Figure 1:
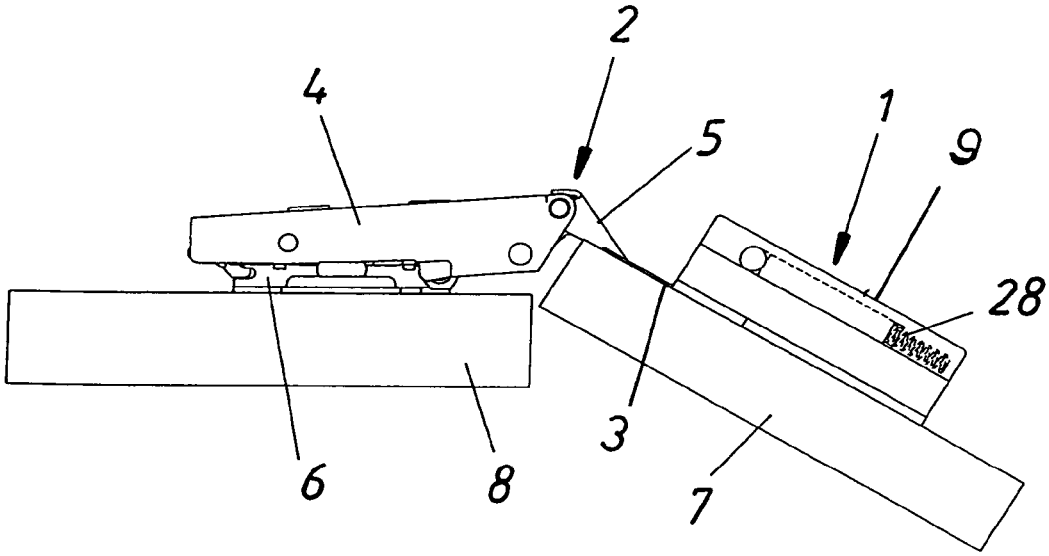
FIG. 1 is a side view of an inventive hinge equipped with a damper, showing parts of one wall of the body and the door of the furniture.
Figure 2:
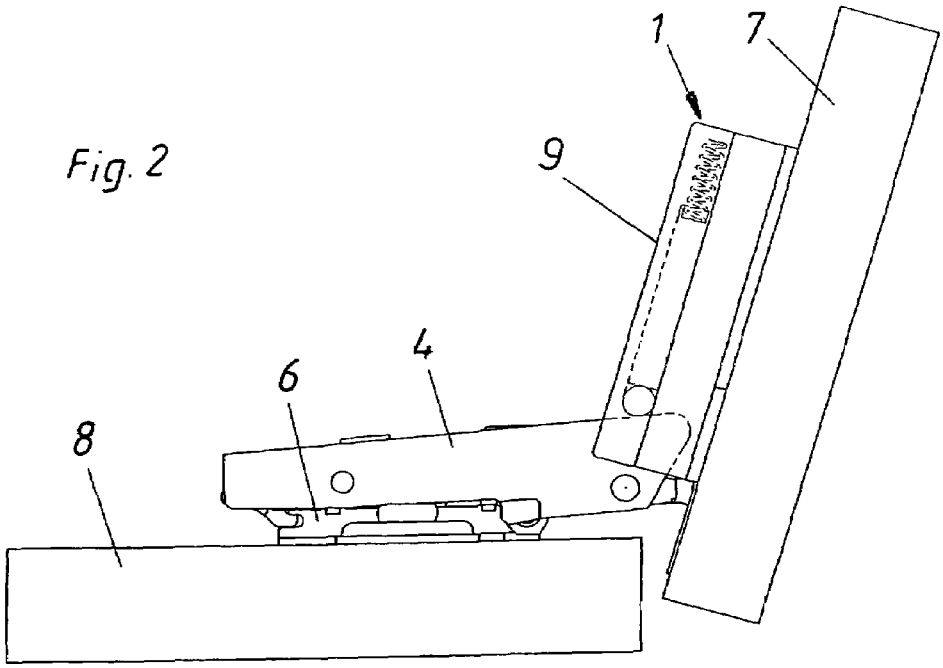
FIG. 2 is a side view of an inventive hinge with a damper, wherein the hinge is shown at the start of the damping path.
Figure 3:
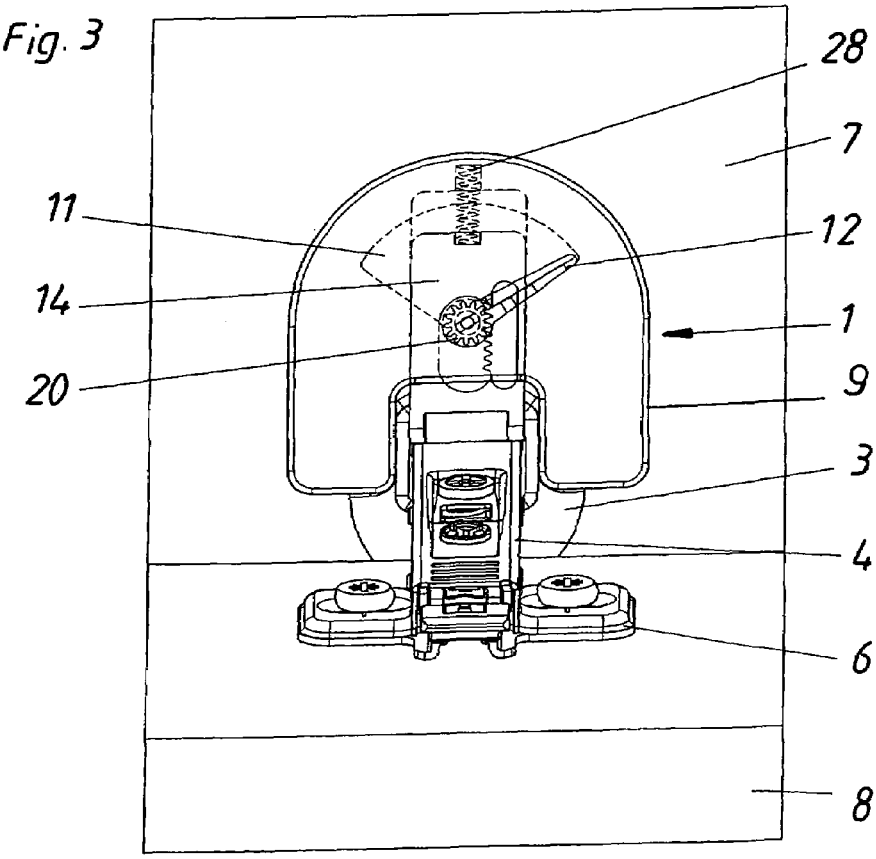
FIG. 3 is a top view of a hinge according to FIG. 2.
Figure 4:
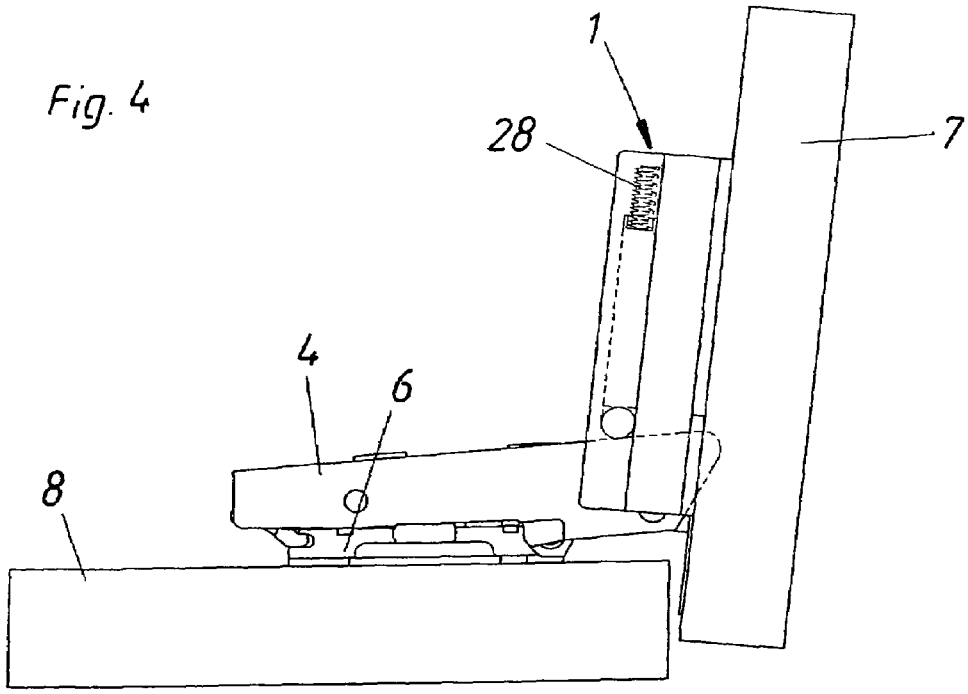
FIG. 4 is a side view of an inventive hinge with a damper, wherein the hinge is shown in the middle of the damping area.
Figure 5:
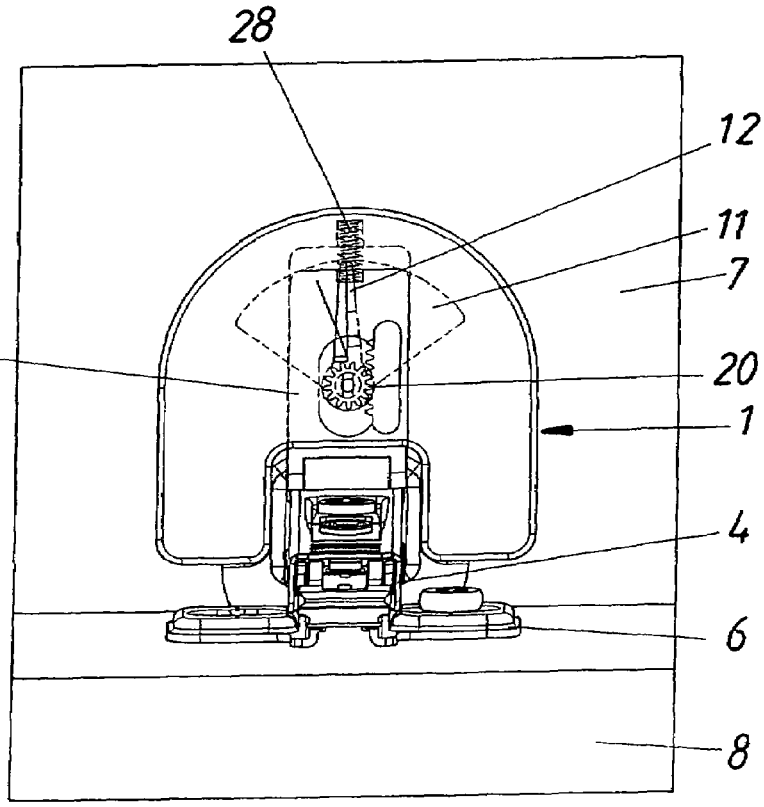
FIG. 5 is a top view of the hinge according to FIG. 4.
Figure 6:
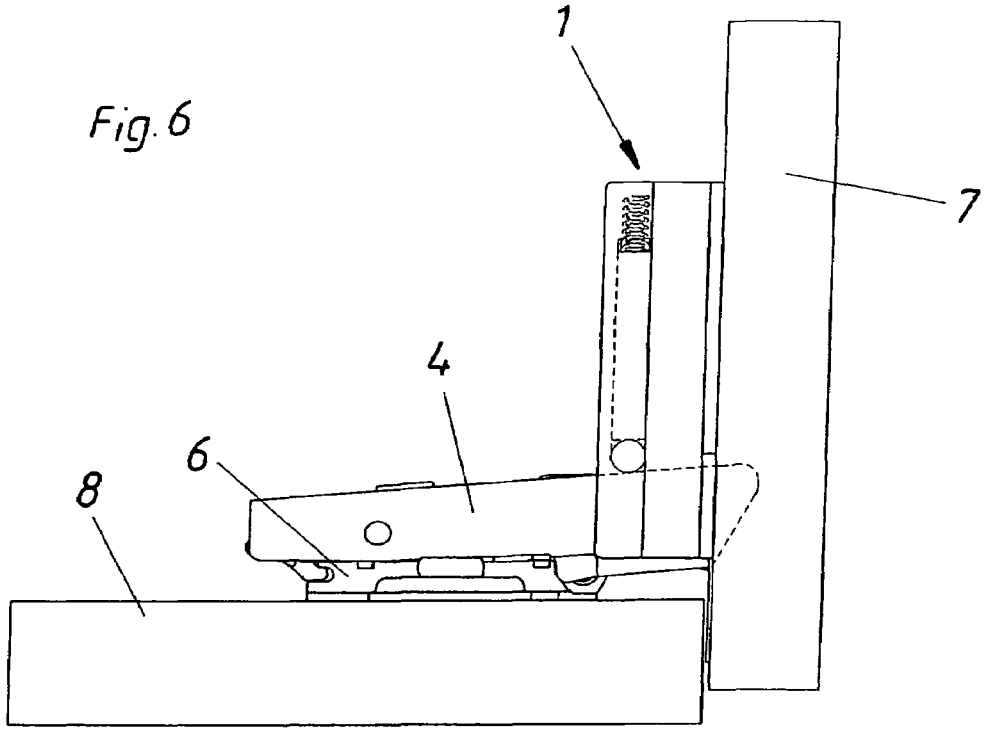
FIG. 6 is a side view of an inventive hinge with a damper, wherein the hinge is shown in the closed position.
Figure 7:
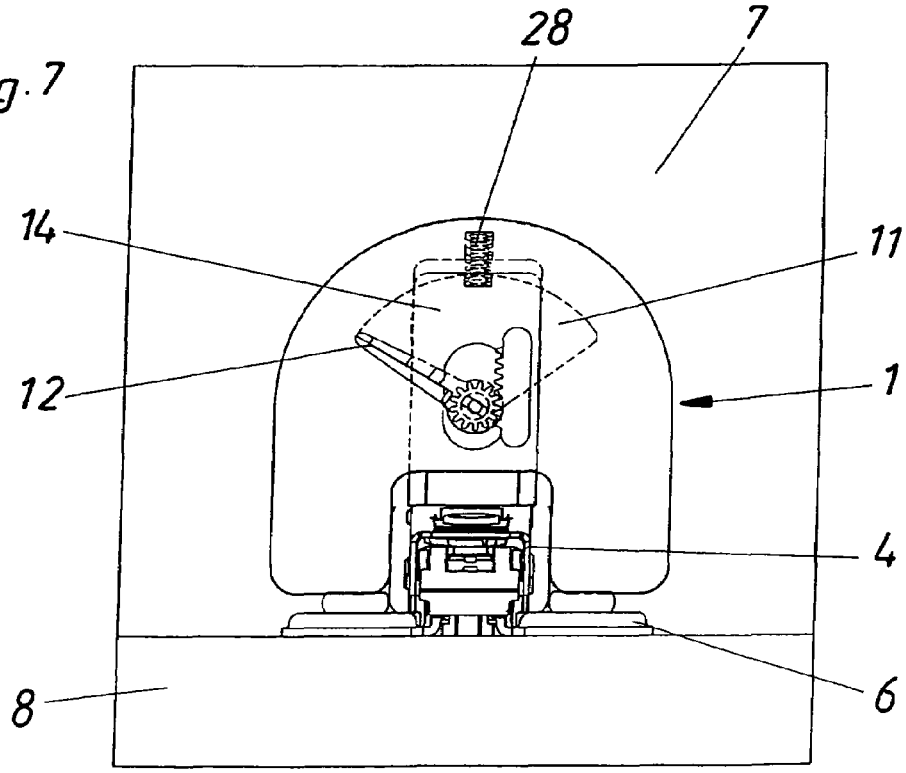
FIG. 7 is a top view of the hinge according to FIG. 6.
Figure 8:
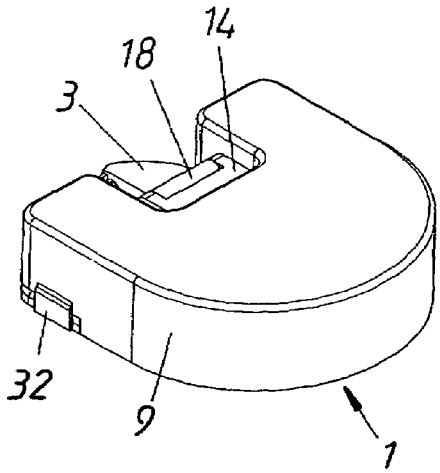
FIG. 8 is a diagram of a damper fixed onto a hinge cup seen from above.
Figure 9:
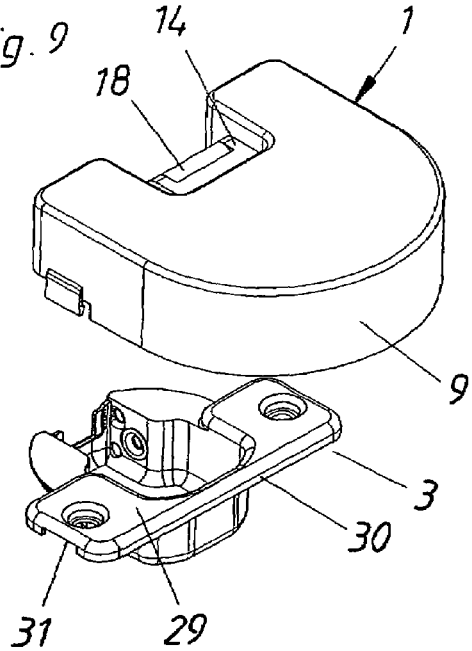
FIG. 9 is an exploded diagram of an inventive damper and a hinge cup.
Figure 10:
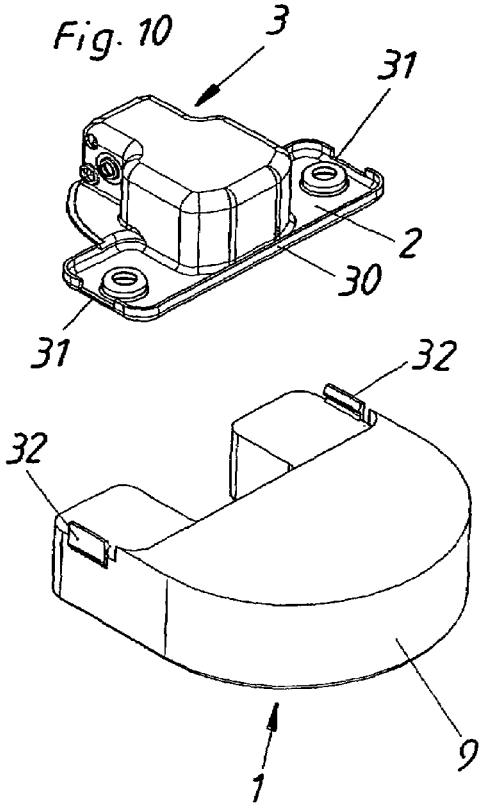
FIG. 10 is an exploded diagram of an inventive damper and a hinge cup, wherein the elements are rotated by 180° with respect to FIG. 8.
Figure 11:
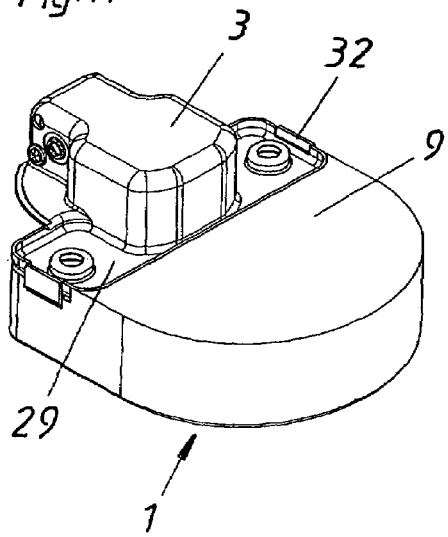
FIG. 11 is a diagram of a hinge cup with the inventive damper.

In the embodiment shown in FIGS. 1-22, the damper 1 is anchored on the hinge cup 3 of a hinge 2. The hinge cup 3 is to be inserted in a bore in the furniture door 7, and is linked via an articulated lever 5 with a hinge arm 4, which is anchored to a base plate 6. The base plate 6 is fixed to a side wall of a furniture body 8, for example screwed into it.

Figure 13:
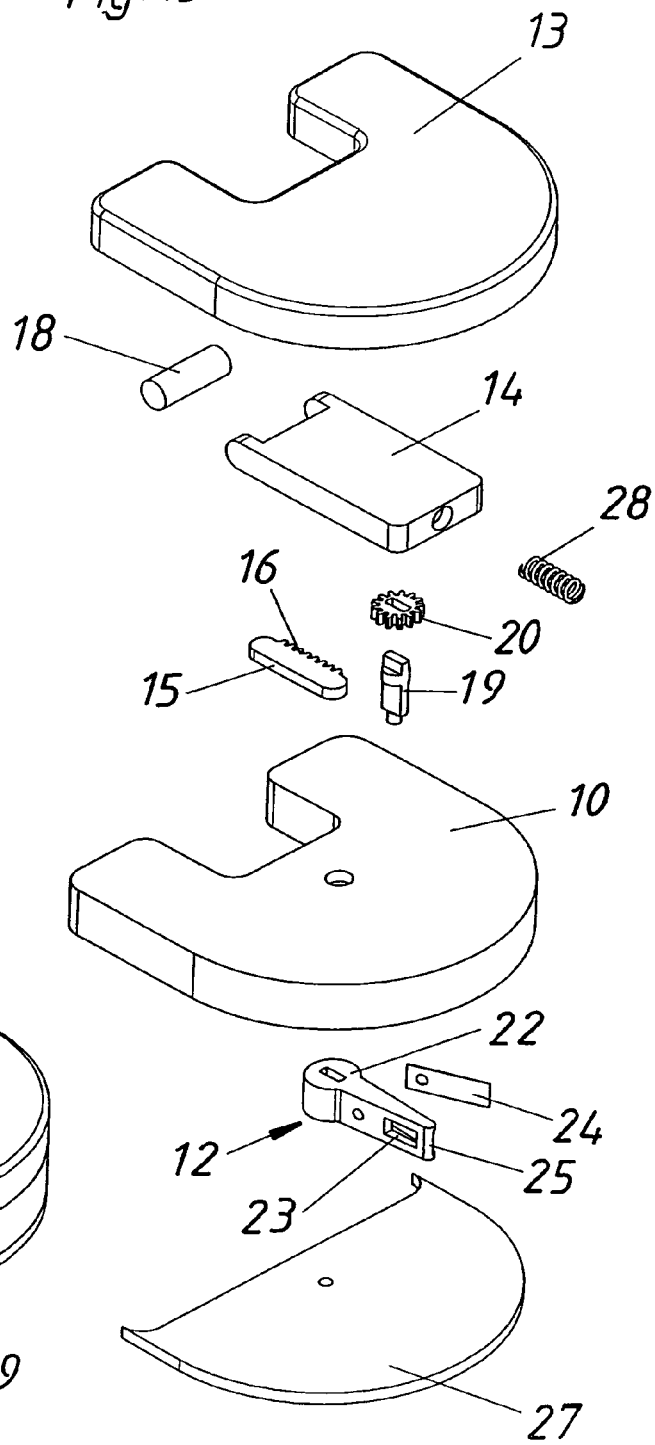
FIG. 13 is an exploded diagram of an inventive damper.
Figure 12:
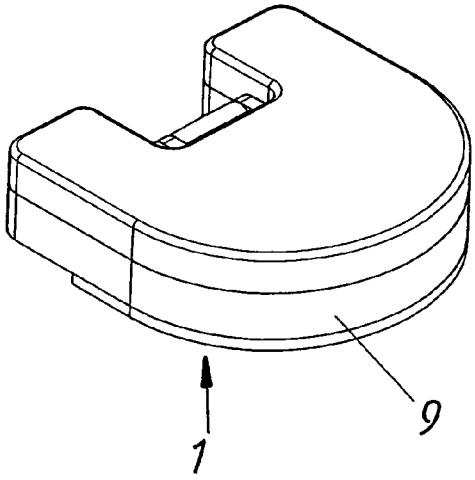
FIG. 12 is a diagram of an inventive damper.
Figure 14:
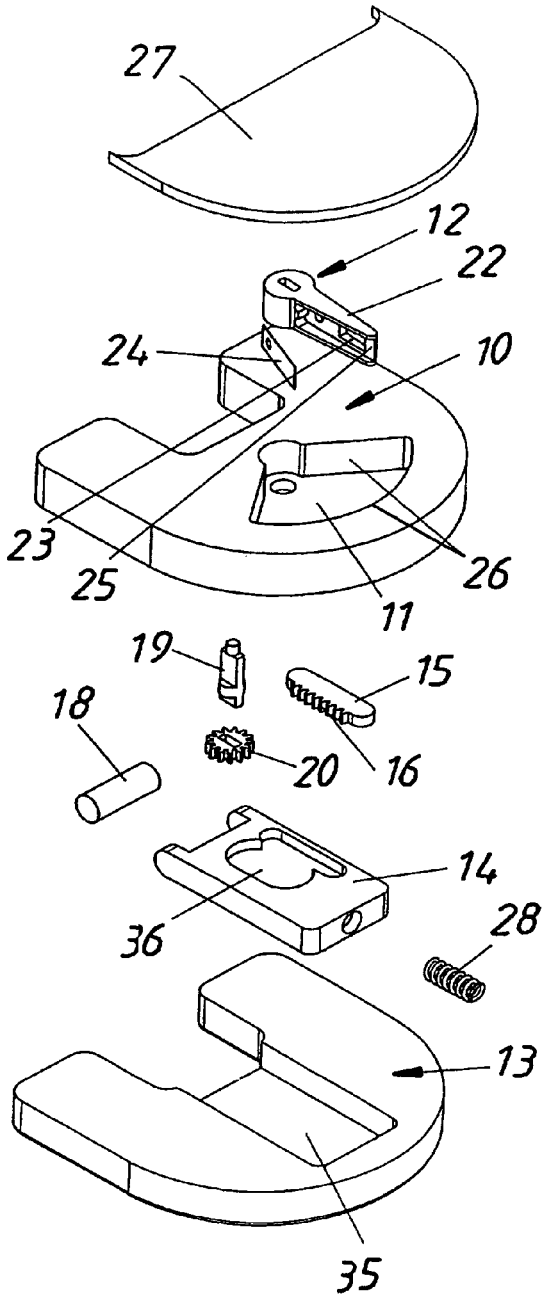
FIG. 14 is an exploded diagram of an inventive damper, wherein the elements are shown rotated by 180° with respect to FIG. 13.
Figure 15:
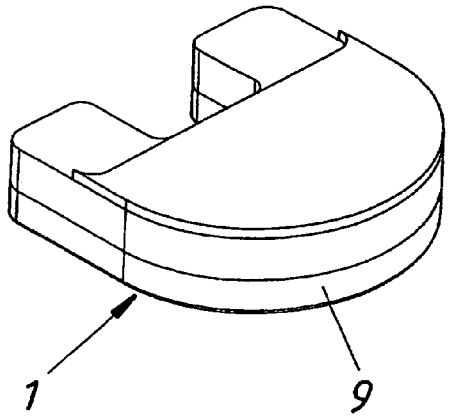
FIG. 15 is a further diagram of an inventive damper.
Figure 18:
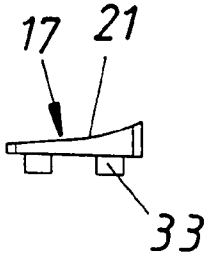
FIGS. 18 to 20 are side views of an attachment.
Figure 19:
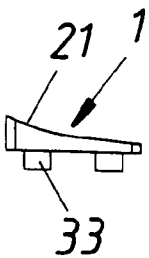
Figure 20:
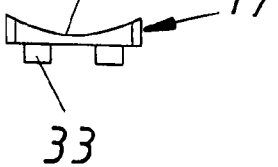
Figure 16:
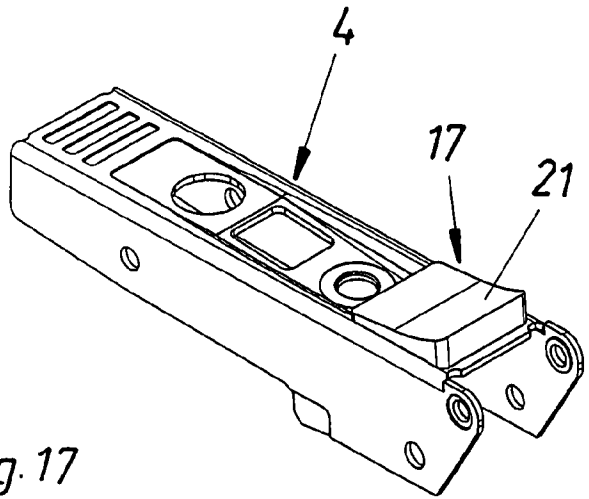
FIG. 16 is a diagram of a hinge arm with an attachment.
Figure 17:
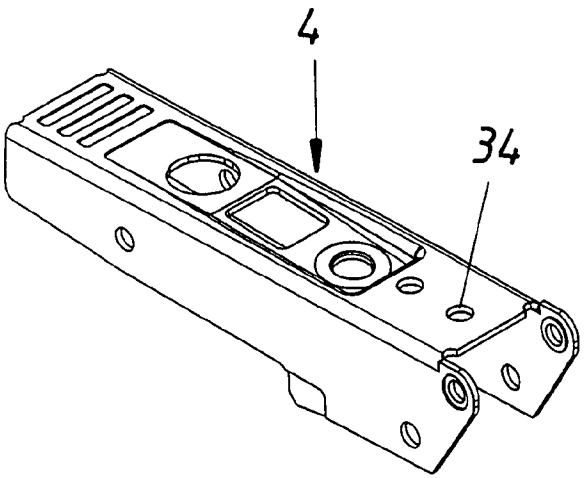
FIG. 17 is a diagram of a hinge arm which is suitable to accept an attachment.
Figure 21:
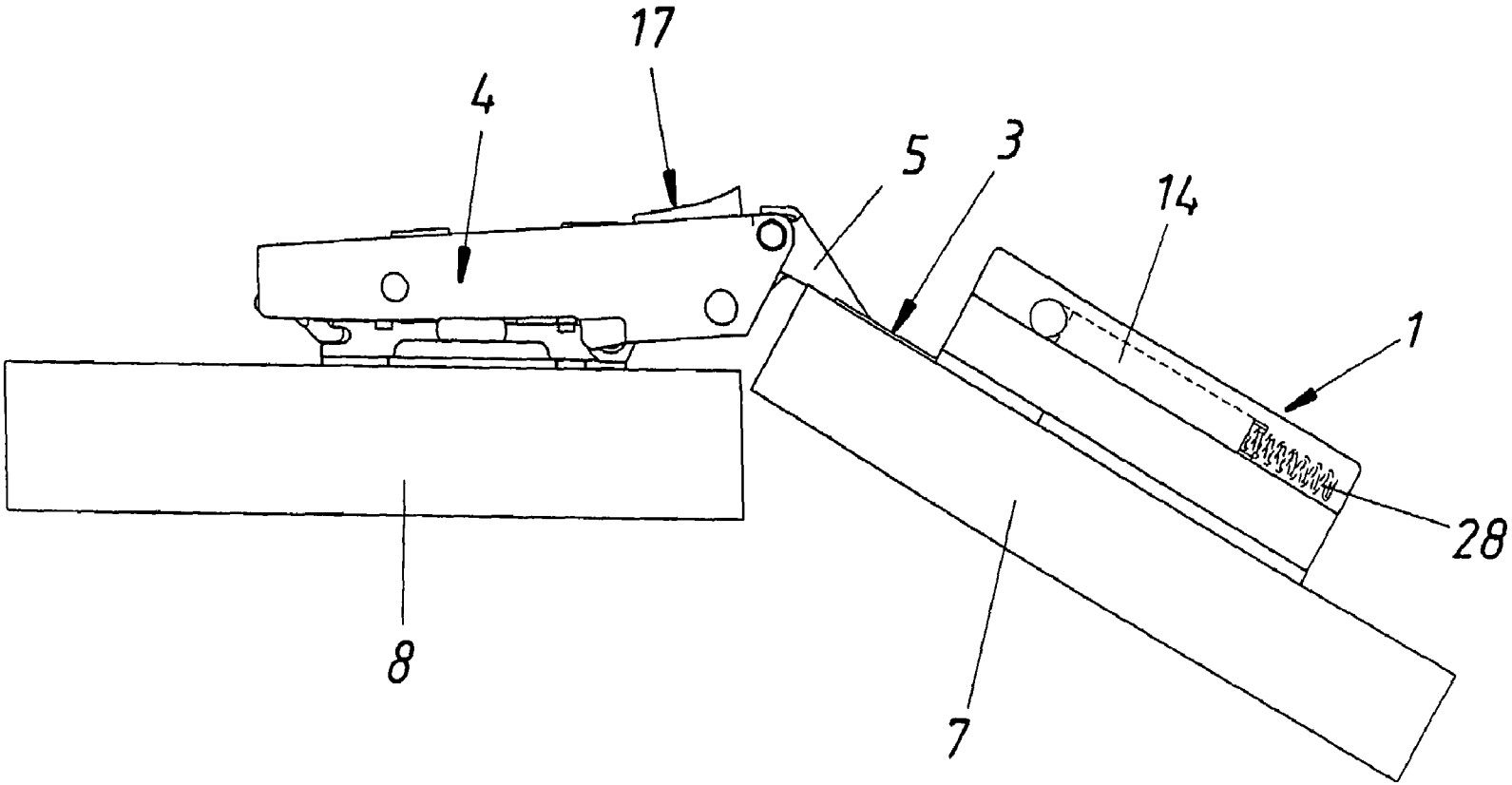
FIG. 21 shows a side view of a hinge with an attachment, in the open position.
Figure 22:
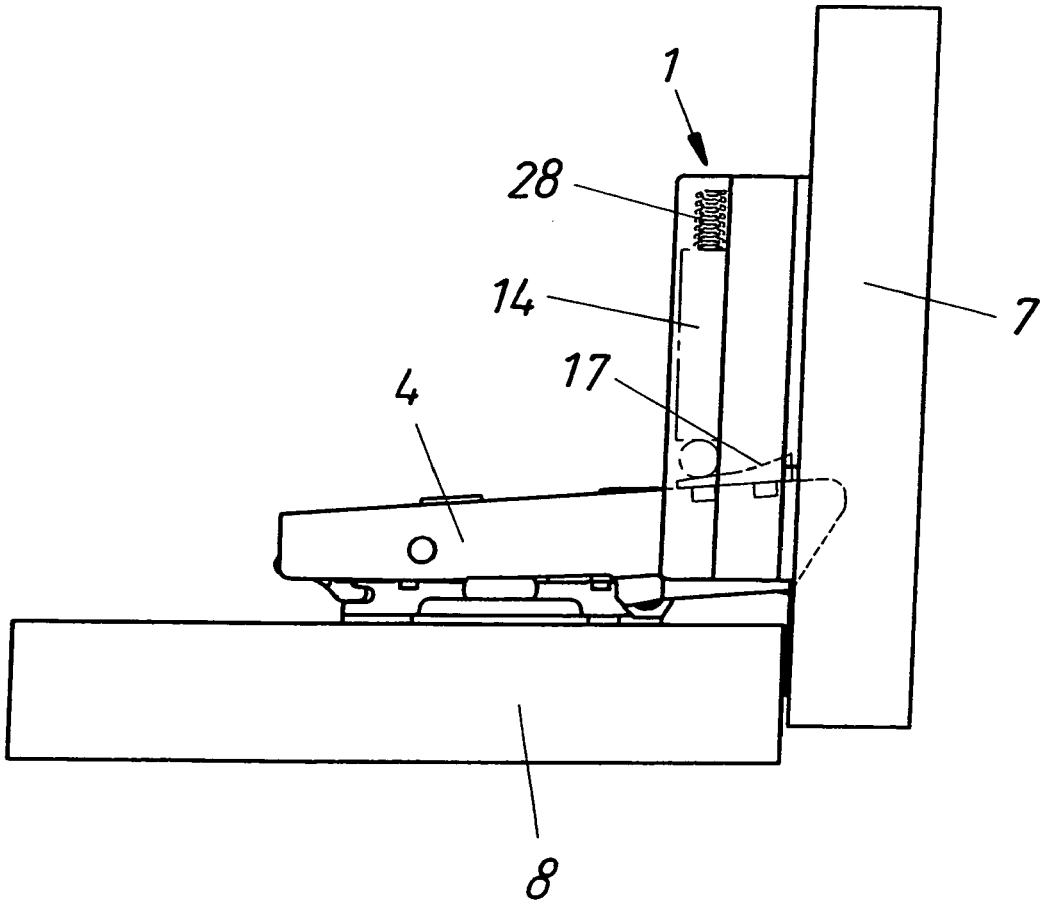
FIG. 22 shows a side view of an inventive hinge with an attachment, in the closed position.

As shown in FIGS. 13 and 14, the damper 1 is in the form of a rotation damper with a rotary piston 12, and comprises a two-part damper housing 9. In a first housing part 10, a cylinder chamber 11 is formed, in which the rotary piston 12 of the damper 1 is disposed. In the second housing part 13, there is a slider 14, which acts as the actuation element. The slider 14 is fitted with an insertion element 15 on which a toothed rack profile 16 is formed. The toothed rack profile 16 could also be formed directly on the slider 14. The insertion element 15 brings purely technical advantages.

The slider 14 moves (is displaced) in a recess 35 in the second housing part 13 and is acted upon by a pressure spring 28. On the end of the slider 14 which projects out of the damper housing 9, the slider 14 has a roller body 18 which rolls away along the hinge arm 4 when the furniture door 7 is closing.

The rotary piston 12 turns (rotates) on an axle 19. At the other end of the axle 19 is a pinion 20, which in the installation position is located in a recess 36 of the slider 14 and meshes with the toothed rack profile 16 of the insertion element 15. Thus, the slider 14 is linked to the rotary piston 12 via the axle 19 and pinion 20.

A wing 22 of the rotary piston 12 has a valve which is formed by an opening 23 in the wing 22 and a leaf spring 24. If the rotary piston 12 is rotated in the direction of damping, the leaf spring 24 closes off the opening 23 in the wing 22, and the damping fluid is pressed through the gap between the tip 25 of the wing 22 and the wall 26 of the cylinder chamber 11 in the damper housing 9. As a result, the desired damping effect is produced. When the furniture door 7 is opened, the rotary piston 12 is rotated in the opposite direction, whereupon the leaf spring 24 opens (i.e., moves away from opening 23) so as to clear the opening 23. Therefore, the damping fluid can also flow through the opening 23. The pressure spring 28 thereby slides the slider 14 back into the ready position.

The damper housing 9 or the housing element 10 respectively is equipped with a cover 27.

An example of a connection means for detachably attaching the damper housing 9 of the damper 1 to the hinge cup 3 is described below. As shown in FIGS. 8-11, the hinge cup 3 has a flange 29 with an edge 30. In the edge 30 on opposite sides of the flange 29, recesses 31 are formed. The damper housing 9 of the rotary damper 1 has moulded elastic hooks 32 which form part of the damper housing 9, and the hooks 32 engage the recesses 31 under the flange 29 when the rotary damper 1 is installed. The rotary damper 1 can thus be mounted onto the hinge cup 3 without using tools by simply pressing it onto the flange 29. Advantageously, the elastic hooks are designed so that the damper housing 9 is also detachable from the flange 29. The damper housing 9 can also be removed from the flange 29 without tools. In other words, the damper housing 9 is detachably attached to the hinge cup 3 by the connection means so that the damper housing 9 can be attached to or detached from the hinge cup 3 without tools.

Since hinge arms 4 can have various forms (for example, there are also cranked hinge arms 4), an attachment 17 can be attached to the hinge arm 4, as shown in FIGS. 16-22. In particular, control surface 21 for the actuation element in the embodiment of the slider 14 is formed on the attachment 17. When the door 7 is closing, the actuation element presses with its free end on the control surface 21. The control surface 21 follows a curved path (i.e., the control surface is curved), which is adapted to the respective requirements. The control surface 21 can be inclined in opposing directions, and can be concave, convex or also straight and angled in form. This allows a specific influencing of the closing characteristics of different hinge types and different closure mechanisms.

The attachment is equipped, for example, with lugs 33, while the hinge arm 4 has holes 34, so that if necessary the attachment 17 can easily be pressed onto the hinge arm 4.

The invention claimed is:

1. A hinge comprising:

a hinge part to be connected to a first furniture part;

a hinge cup to be inserted into a bore in a second furniture part, said hinge cup being pivotally connected to said hinge part; and a damper including a damper housing and an elastic connection means for detachably snapping said damper housing to onto said hinge cup so as to establish a rigid connection between said damper housing and said hinge cup for absorbing forces exerted on said damper during operation of said hinge, said connection means being shaped and arranged to attach said damper housing to said hinge cup by hand without tools and to detach said damper housing from said hinge cup by hand without tools, said damper housing and said hinge cup being shaped and arranged such that said damper housing is located at least partially out of the bore of the second furniture part when said hinge cup is inserted into the bore and said damper housing is attached to said hinge cup.

2. The hinge of claim 1, wherein said damper housing and said hinge cup are shaped and arranged such that said damper housing is located entirely out of the bore when said hinge cup is inserted into the bore and said damper housing is attached to said hinge cup.

3. The hinge of claim 1, wherein said connection means comprises elastic hooks for detachably snapping said damper housing to onto said hinge cup.

4. The hinge of claim 3, wherein said damper housing having said hooks is made of injected plastic such that said damper housing and said hooks are integrated to have a one-piece construction.

5. The hinge of claim 3, wherein said hooks are located on opposite outer sides of said damper housing so as to be accessible from outside of said damper housing.

6. The hinge of claim 1, wherein said hinge cup has a flange for abutting the second furniture part, said connection means being shaped and arranged to detachably snap said damper housing onto said flange of said hinge cup.

7. The hinge of claim 6, wherein said flange has an edge with recesses for engaging elastic fastening hooks of said connection means.

8. The hinge of claim 6, wherein said hinge part comprises a hinge arm linked in an articulated manner to said hinge cup, said hinge arm including an attachment having a control surface for contacting an actuation element of said damper.

9. The hinge of claim 8, wherein said attachment includes at least one lug for fixing said attachment to said hinge arm.

10. The hinge of claim 8, wherein said control surface is curved.

11. The hinge of claim 8, wherein said attachment is located at an end of said hinge arm to which said hinge cup is linked.

12. The hinge of claim 1, wherein said hinge part comprises a hinge arm linked in an articulated manner to said hinge cup, said hinge arm including an attachment having a control surface for contacting an actuation element of said damper.

13. A hinge comprising:

a hinge part to be connected to a first furniture part, a hinge cup to be inserted into a bore in a second furniture part, said hinge cup being pivotally connected to said hinge part; and a damper including a damper housing and a connection means for detachably attaching said damper housing to said hinge cup so as to establish a rigid connection between said damper housing and said hinge cup for absorbing forces exerted on said damper during operation of said hinge, said connection means being shaped and arranged to attach said damper housing to said hinge cup by hand without tools and to detach said damper housing from said hinge cup by hand without tools, said damper housing and said hinge cup being shaped and arranged such that said damper housing is located at least partially out of the bore of the second furniture part when said hinge cup is inserted into the bore and said damper housing is attached to said hinge cup;

wherein said damper further includes a rotary piston having at least one wing operable to be moved through said damper housing, wherein a gap between a tip of said wing and a wall of said damper housing defines a passage for flow of a damping fluid.

14. The hinge of claim 13, wherein said damper housing has a chamber in which said rotary piston is accommodated, said chamber having side walls delimiting a movement of said at least one wing, one of said side walls of said chamber comprising said wall of said damper housing defining said passage.

15. The hinge of claim 13, wherein said damper housing comprises a first housing part accommodating said rotary piston and a second housing part accommodating an actuation element of said damper.

16. The hinge of claim 15, wherein said actuation element comprises a slider linked to said rotary piston.

17. The hinge of claim 16, wherein said rotary piston is connected to an axle such that said rotary piston rotates about said axle, said axle being connected to a pinion engaging a toothed rack of said slider so as to link said rotary piston to said slider.

18. The hinge of claim 13, wherein said wing of said rotary piston has a flap.

19. The hinge of claim 18, wherein said flap comprises a leaf spring.

* * * * *